US009161608B2

(12) United States Patent
Achola

(10) Patent No.: US 9,161,608 B2
(45) Date of Patent: Oct. 20, 2015

(54) GARMENT, CARRY BAG, AND FASTENER FOR FASTENING A CARRY BAG TO A PERSON'S BODY

(71) Applicant: Jenipher Adero Achola, Nairobi (KE)

(72) Inventor: Jenipher Adero Achola, Nairobi (KE)

( * ) Notice: Subject to any disclaimer, the term of this patent is extended or adjusted under 35 U.S.C. 154(b) by 0 days.

(21) Appl. No.: 14/279,347

(22) Filed: May 16, 2014

(65) Prior Publication Data

US 2014/0339279 A1 Nov. 20, 2014

Related U.S. Application Data

(63) Continuation of application No. PCT/KE2012/000029, filed on Nov. 16, 2012.

(30) Foreign Application Priority Data

Nov. 18, 2011 (KE) ..... 11/001488

(51) Int. Cl.

| | |
|---|---|
| ***A45F 3/04*** | (2006.01) |
| ***A41D 15/04*** | (2006.01) |
| ***A45F 3/00*** | (2006.01) |
| ***A45F 4/12*** | (2006.01) |
| ***A41D 1/04*** | (2006.01) |
| ***A45F 3/14*** | (2006.01) |

(52) U.S. Cl.

CPC ... *A45F 3/00* (2013.01); *A41D 1/04* (2013.01); *A45F 3/14* (2013.01); *A45F 4/12* (2013.01); *A41D 15/04* (2013.01); *A41D 2400/48* (2013.01); *A45F 3/04* (2013.01); *A45F 2003/003* (2013.01)

(58) Field of Classification Search

CPC ..... A45F 3/04; A41D 15/04

See application file for complete search history.

(56) References Cited

U.S. PATENT DOCUMENTS

| | | | | | |
|---|---|---|---|---|---|
| 2,620,479 | A | * | 12/1952 | Buck | 2/94 |
| 2,982,105 | A | * | 5/1961 | Akers | 405/186 |
| 3,116,491 | A | * | 1/1964 | Previdi et al. | 2/106 |
| 4,272,852 | A | * | 6/1981 | Bell | 2/94 |
| 4,302,847 | A | * | 12/1981 | Miles | 2/465 |
| 4,389,735 | A | * | 6/1983 | McLaughlin | 2/94 |
| D269,561 | S | * | 7/1983 | Scott | D2/829 |
| 4,793,534 | A | * | 12/1988 | Berry | 224/623 |
| 5,002,270 | A | * | 3/1991 | Shine | 482/105 |
| 5,247,707 | A | * | 9/1993 | Parker et al. | 2/102 |
| 5,634,579 | A | * | 6/1997 | Baclawski | 224/637 |
| 5,639,005 | A | * | 6/1997 | Chouinard | 224/580 |
| D394,338 | S | * | 5/1998 | Lacey | D2/841 |
| 5,754,982 | A | * | 5/1998 | Gainer | 2/2.5 |
| 5,890,227 | A | * | 4/1999 | Brown | 2/102 |
| 5,909,802 | A | * | 6/1999 | Puco et al. | 2/102 |
| 6,131,199 | A | * | 10/2000 | Bugel et al. | 2/102 |

(Continued)

FOREIGN PATENT DOCUMENTS

GB 2355913 5/2001

*Primary Examiner* — Justin Larson

(74) *Attorney, Agent, or Firm* — Isaac Rutenberg

(57) ABSTRACT

This invention discloses a fastener for fastening a carry bag to a person's body, characterized by a garment having at least one reinforced member. The reinforced member is integrally formed with the garment. It has an elongate strap and a container portion of a backpack or rucksack. The reinforced member includes connector means for connecting the reinforced member to an engagement means of the carry bag. The garment may be, for example, a waistcoat, collared vest or a front portion of a waistcoat or collared vest that extends to a carry bag, rucksack, or backpack.

14 Claims, 4 Drawing Sheets

(56) References Cited

U.S. PATENT DOCUMENTS

| | | | | |
|---|---|---|---|---|
| 6,314,579 | B1 * | 11/2001 | Marcon | 2/102 |
| 6,336,222 | B1 * | 1/2002 | Ware | 2/94 |
| 6,397,392 | B1 * | 6/2002 | Wooley et al. | 2/102 |
| 6,637,547 | B1 * | 10/2003 | Wydner | 182/3 |
| 6,658,666 | B2 * | 12/2003 | Schweer | 2/94 |
| 6,675,391 | B2 * | 1/2004 | Morrison | 2/102 |
| D516,777 | S * | 3/2006 | Beck | D2/829 |
| D526,468 | S * | 8/2006 | Dingman et al. | D2/829 |
| 7,243,376 | B2 * | 7/2007 | Johnson | 2/102 |
| 7,363,659 | B1 * | 4/2008 | Colbert | 2/86 |
| D575,931 | S * | 9/2008 | Broudy | D2/839 |
| 7,490,361 | B1 * | 2/2009 | Floyd | 2/94 |
| D594,633 | S * | 6/2009 | Floyd | D2/829 |
| D611,680 | S * | 3/2010 | Thomas | D2/830 |
| 7,735,151 | B1 * | 6/2010 | Young et al. | 2/96 |
| 7,886,368 | B2 * | 2/2011 | Hood | 2/102 |
| 8,387,166 | B2 * | 3/2013 | Eastep | 2/102 |
| 2002/0120973 | A1 * | 9/2002 | D'Annunzio | 2/92 |
| 2006/0117453 | A1 | 6/2006 | Hood | |

* cited by examiner

GARMENT, CARRY BAG, AND FASTENER FOR FASTENING A CARRY BAG TO A PERSON'S BODY

CROSS-REFERENCE TO RELATED APPLICATIONS

This application claims priority to PCT/KE2012/000029, filed Nov. 16, 2012, which application claims priority to Kenya Patent Application Serial No. KE/P/2011/001448, filed Nov. 18, 2011, the disclosures of which are incorporated herein by reference.

FIELD OF THE INVENTION

This invention relates to apparel for everyday use. More particularly, the invention relates to a garment, a carry bag, and a fastener for fastening a carry bag to a person's body.

BACKGROUND TO THE INVENTION

Backpacks have been known for many years and take a variety of forms, but nowadays in addition to its functional purpose, backpacks also need to be aesthetically pleasing to fit in with the appearance and/or 'image' of the wearer thereof. In the past, backpacks had been used as a primary means of transporting education materials to and from, for example, a school. This has changed and young people are increasingly purchasing backpacks only if they are suitably fashionable and attractive, in addition to being useful.

A backpack is very easy to carry around but many consider backpacks to be childish and meant for students only. Backpacks and, in particular, their straps are often considered unappealing as they differ in colour from the attire worn by the wearer. The straps, which extend over the wearer's shoulders and onto a front portion of his or her upper body, are always prominent and this contributes to conventional backpacks being unlikeable, especially by teenagers and students who commonly refer to it as the unprofessional backpack strap effect.

This invention attempts to, at least in part, address the above issues and provide a carry bag that is more appealing to a wider range of people.

SUMMARY OF THE INVENTION

In accordance with this invention there is provided a fastener for fastening a carry bag to a person's body, the fastener comprising a garment having at least one reinforced member operable to in use be connected to engagement means of the carry bag so as to assist the person in carrying a load packed into the carry bag.

There is also provided for the at least one reinforced member to be integrally formed with the garment. The at least one reinforced member may further be secured to an interior portion of the garment so as to be unnoticeable when the garment is worn.

There is further provided for the at least one reinforced member to be an elongate strap.

The carry bag is typically a container portion of a backpack or rucksack.

In addition, there is provided for the at least one reinforced member to include at least one connector for connecting said reinforced member to the engagement means of the carry bag.

The connector and engagement means are preferably, but not necessarily complementary shaped and may compromise complimentary shaped buckles, hooks and loops, or zipper portions.

The invention provides for the garment to be a waistcoat or collared vest or a front portion of a waistcoat or collared vest.

The invention further extends to a garment having at least one reinforced member connectable to engagement means of a carry bag adapted to be carried on a person's body so as to in use assist the person in carrying a load packed into the carry bag.

Preferably, the at least one reinforced member is integrally formed with the garment. Alternatively the at least one reinforced member, which typically is a strap, is secured to an interior portion of the garment so as to be unrecognizable when worn.

Still further, the invention extends to a carry bag, rucksack, or backpack having a garment as described hereinbefore.

In an aspect, there is provided a fastener for fastening a carry bag to a person's body, the fastener comprising a garment having at least one reinforced member operable to in use be connected to engagement means of the carry bag so as to assist the person in carrying a load packed into the carry bag.

In embodiments:

the least one reinforced member is integrally formed with the garment;

the at least one reinforced member is secured to an interior portion of the garment so as to be unnoticeable when the garment is worn;

the at least one reinforced member is an elongate strap;

the carry bag is a container portion of a backpack;

the at least one reinforced member includes at least one connector for connecting said reinforced member to the engagement means of the carry bag;

the connector and engagement means are complementary shaped;

the connector and engagement means comprises complementary shaped buckles, hooks and loops or zipper portions;

the garment is a waistcoat or collared vest; and the garment is a front portion of a waistcoat or collared vest.

In another aspect, there is provided a garment having at least one reinforced member connectable to engagement means of a carry bag adapted to be carried on a person's body so as to in use assist the person in carrying a load packed into the carry bag.

In embodiments:

the at least one reinforced member is integrally formed with the garment;

the at least one reinforced member is secured to an interior portion of the garment so as to be unrecognizable in use;

the at least one reinforced member is an elongate strap; and the carry bag is a container portion of a backpack.

In another aspect, there is provided a carry bag including the garment as described herein.

In another aspect, there is provided a fastener, garment, or carry bag as per above.

In another aspect, there is provided a garment fastener comprising a front panel, the front panel comprising: (a) a first chest covering portion comprising an upper connector disposed in a shoulder region of the first chest covering portion and a lower connector disposed in a waist region of the first chest covering portion; (a) a second chest covering portion comprising an upper connector disposed in a shoulder region of the second chest covering portion and a lower connector disposed in a waist region of the second chest covering portion; (c) a first reinforced member in physical communication with the upper connector of the first chest covering portion; and (d) a second reinforced member in physical communication with the upper connector of the second chest covering portion, wherein the front panel is configured to at least partially cover the chest of a user.

In embodiments:

the first chest covering portion comprises a centre connector configured to engage with a centre connector of the second chest covering portion, and wherein the first chest covering portion and the second chest covering portion are separable;

the first chest covering portion and the second chest covering portion are integrally connected;

the upper connector of the first chest covering portion is configured to engage with a first upper connector of a back member, the upper connector of the second chest covering portion is configured to engage with a second upper connector of the back member, the lower connector of the first chest covering portion is configured to engage with a first lower connector of the back member, and the lower connector of the second chest covering portion is configured to engage with a second lower connector of the back member;

the back member is selected from a carry bag and a back panel;

the first and second reinforced members are integrally formed with the first and second chest covering portions, respectively;

the first and second reinforced members are disposed on the inside of the first and second chest covering portions, respectively, and are configured so as not to be visible when the garment fastener is worn by a person;

the first chest covering portion comprises an outer surface, an inner surface, and a first lining covering at least a portion of the inner surface, and wherein the second chest covering portion comprises an outer surface, an inner surface, and a second lining covering at least a portion of the inner surface;

the first reinforced member is disposed between the first chest covering portion and the first lining, and wherein the second reinforced member is disposed between the second chest covering portion and the second lining;

the first reinforced member is in physical communication with the lower connector of the first chest covering portion, and wherein the second reinforced member is in physical communication with the lower connector of the second chest covering portion.

In another aspect, there is provided a garment comprising the garment fastener as above engaged with a back member, the back member comprising: a first upper connector disposed in a shoulder region of the back member and configured to engage with the upper connector of the first chest covering portion; a second upper connector disposed in a shoulder region of the back member and configured to engage with the upper connector of the second chest covering portion; a first lower connector disposed in a waist region of the back member and configured to engage with the lower connector of the first chest covering portion; and a second lower connector disposed in a waist region of the back member and configured to engage with the lower connector of the second chest covering portion.

In embodiments:

the front panel and back member are configured to form first and second arm holes, a neck hole, and a torso hole when fully engaged;

the back member is selected from a carry bag and a back panel;

the first reinforced member is configured to support at least a portion of the weight of the back member when the upper connector of the first chest covering portion is engaged with the first upper connector of the back member, and wherein the second reinforced member is configured to support at least a portion of the weight of the back member when the upper connector of the second chest covering portion is engaged with the second upper connector of the back member; and the back member is configured to at least partially cover the back of the user.

These and other aspects of the invention will be apparent to one of ordinary skill in the art from the disclosure provided herein. All combinations of the various aspects and limitations described herein are within the scope of the invention, and this statement serves as antecedent basis for such combinations as if each was laboriously written out.

BRIEF DESCRIPTION OF THE DRAWINGS

Embodiments of the invention will now be described, by way of example, with reference to the accompanying non-limiting diagrammatic drawings. In the drawings.

DETAILED DESCRIPTION OF THE DRAWINGS

Figure 1:
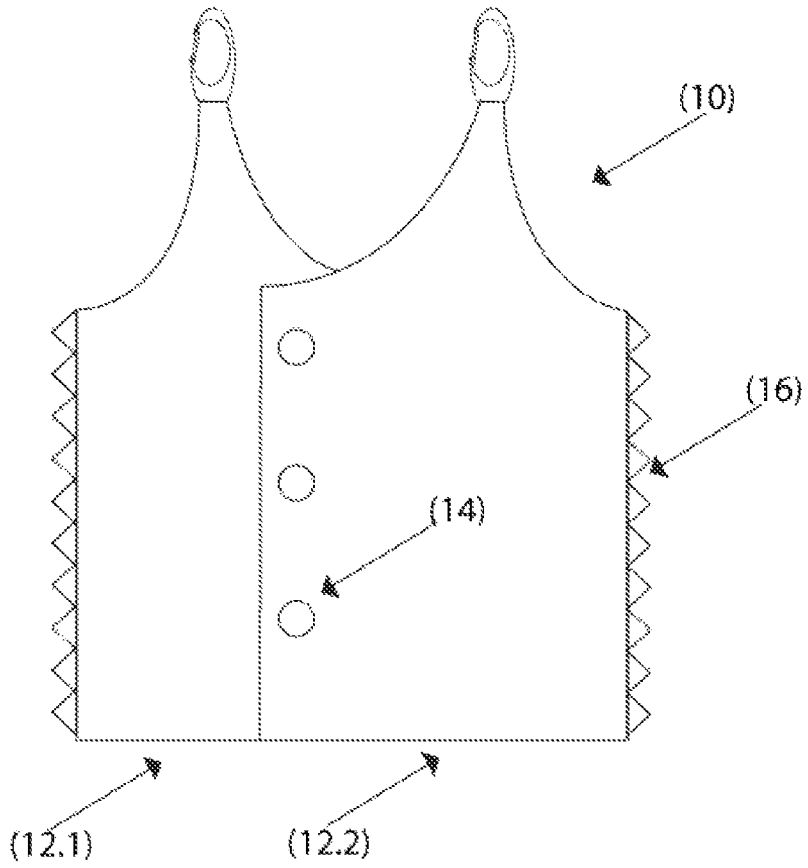
FIG. 1 shows a simplified front elevation of a fastener for fastening a carry bag to a person's body in accordance with a first embodiment of the invention.

In one aspect of the invention, there is provided a garment fastener comprising a front panel, the front panel comprising: (a) a first chest covering portion comprising an upper connector disposed in a shoulder region of the first chest covering portion and a lower connector disposed in a waist region of the first chest covering portion; (a) a second chest covering portion comprising an upper connector disposed in a shoulder region of the second chest covering portion and a lower connector disposed in a waist region of the second chest covering portion; (c) a first reinforced member in physical communication with the upper connector of the first chest covering portion; and (d) a second reinforced member in physical communication with the upper connector of the second chest covering portion, wherein the front panel is configured to at least partially cover the chest of a user.

As used herein, a "user" is a person wearing the garment fasteners or garments described herein.

In embodiments, the first chest covering portion and the second chest covering portion combine to form the front panel's area of coverage of a user (i.e., a person wearing the garment fastener). The "area of coverage" is the portion of a user that is covered by the garment or garment fastener, such as the entire chest area, or the chest area plus the arms, or the chest area plus the neck and arms, etc. The shape of the chest covering portions will therefore vary according to the desired area of coverage.

In embodiments, each chest covering portion has a shoulder region that covers all or a portion of a user's shoulder and a waist region that covers all or a portion of a user's waist. The shoulder region may extend to the apex of the shoulder or may terminate below or past the apex, but is generally configured such that the upper connector is configured to engage with an upper connector of the back member (as described herein).

In embodiments, the waist region of a single chest covering portion covers one-quarter of the user's waist, extending from approximately the center-midpoint of the waist around to approximately the side-midpoint of the waist. At the center-midpoint is a center connector when the two chest covering portions are not integrally connected at the center-midpoint. The center connector may extend from the top to the bottom of the chest covering portions (e.g., a zipper extending the length of the chest covering portion) or may be present at only a portion of the chest covering portion (e.g., one or a plurality of buttons located in the waist region, as exemplified in FIG. 1). At the side-midpoint of the waist region of a chest covering portion is the lower connector, and this connector is configured to engage with a lower connector of the back member (as described herein). The waist regions of first and second chest covering portions may overlap, as exemplified in FIG. 1.

In embodiments, the chest covering portions are integrally connected, meaning that they are not separable. For example, a single piece of uncut fabric forms the first and second chest covering portions, or two pieces of fabric are used and are sewn together so as to be not separable (other than by destroying the seam). In other embodiments, the first and second chest covering portions are separable and are therefore joined by a center connector. When the garment fastener is worn by a user, the chest covering portions are joined at or near the center of the user's chest by the center connector.

In embodiments, each chest covering portion comprises a reinforced member. The reinforced member is a structural component that is configured to allow/assist the user to engage a carry sack as the back member as described herein. The reinforced member is therefore in communication (i.e., directly attaching to) with the upper connector of the chest covering portion, and is configured to support or distribute weight that is attached to the upper connector. The size and shape of the reinforced member will vary. For example, in embodiments the reinforced member is an elongate strap, which may extend from the upper connector to the lower connector of the same chest covering portion, and/or to the center connector of the same chest covering portion. In embodiments, the reinforced member is integrally formed with the chest covering portion, meaning that it is not removable (e.g., it is sewn into the chest covering portion). In embodiments, the reinforced member comprises a fabric that is stronger and/or thicker than other parts of the garment fastener. For example, the reinforced member is made of the same type fabric as the remaining parts of the chest covering portion, but includes several layers of such fabric that combine to make the reinforced member stronger. Also for example, the reinforced member is made of a different type of fabric as the remaining parts of the chest covering portion, wherein such fabric is stronger and/or thicker.

In embodiments, the reinforced member is disposed on an inner surface of the chest covering portion, wherein the "inner surface" is the side that faces and contacts the user when the garment is worn. Thus, the reinforced member is not directly visible by others when the garment is in use.

In embodiments, the inner surface of a chest covering portion is covered by a lining. In some such embodiments, the lining is suitable as an outer fabric, and the garment fastener is reversible (i.e., may be worn with either side contacting the user). In other such embodiments, the lining is an inner lining such as a silk lining, and provides enhanced comfortability of the garment. In some embodiments, the reinforced member is disposed between the chest covering portion and the lining of the chest covering portion. In such embodiments, the reinforced member is not visible regardless of which surface is worn on the outside of the garment.

In embodiments, the front panel resembles a vest, jacket, sleeveless dress, or the like. The front panel may have any desired decorations, and may be made from any suitable material(s). Additional components such as pockets, collars, and the like are also within the scope of the invention.

In embodiments, the front panel is configured to engage with a back member. Such engagement typically involves engagement of the upper connectors and lower connectors of the chest covering portions with corresponding upper connectors and lower connectors of the back member. The back member is configured to at least partially cover the back of a user, and may cover the entire back, the back plus arms regions, the back plus neck region, or the like. In embodiments, the back member is a back panel that is a single layer of fabric and serves merely to secure the garment fastener to the user's body. In other embodiments, the back member comprises a carry bag. A carry bag includes front, side, bottom, and top panels that form a container portion of the back member such as a rucksack or backpack. The container portion may cover the entire back member or may cover only a portion of the back member.

The combination of the garment fastener and the back member is referred to herein as a garment. Such garment may be functional, such as when the back member is a carry bag, or may be purely aesthetic, such as when the back member is a single layer of fabric. Such garment comprises first and second arm holes, a neck hole, and a torso hole.

Connectors used in the garment fasteners and garments described herein are reversible-type engaging means typically associated with garments. Examples of the various connectors include zippers, buckles (including three-prong buckles, belt buckles, etc.), buttons, laces, clips, hook-and-loop (i.e., VELCRO®), snaps, clasps, and the like. Where two members are joined using a connector, each of the members has a connector portion that is complimentary to the connector portion of the other member. For example, one member may have a button and the other member has a buttonhole.

In the drawings, like numerals indicate like components unless otherwise indicated.

Figure 2:
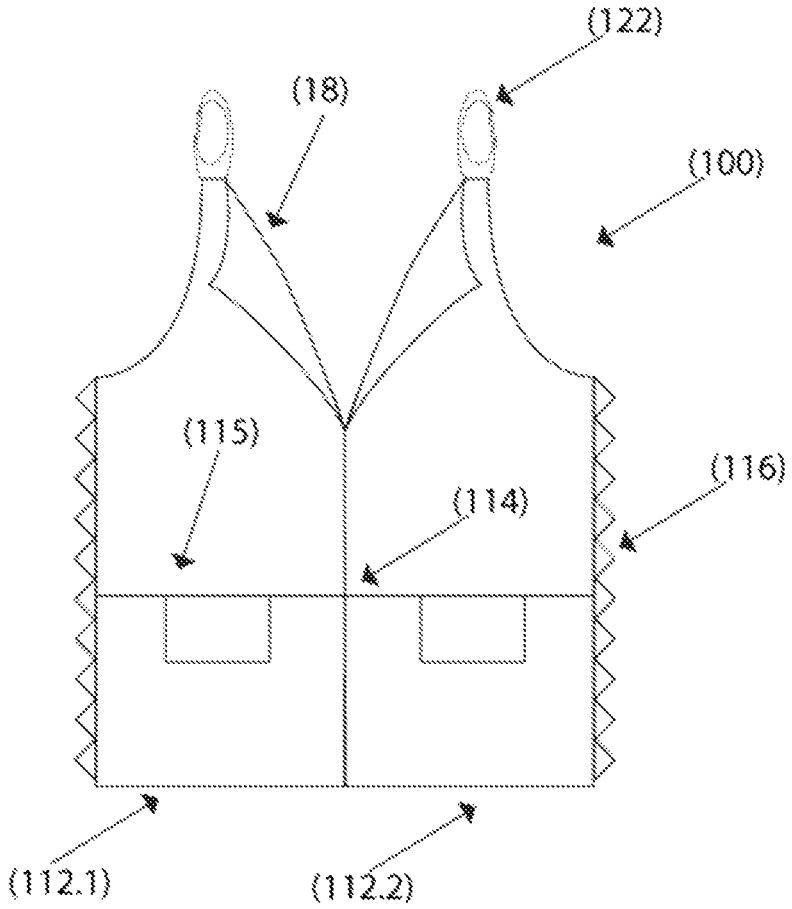
FIG. 2 shows a simplified front elevation of a fastener for fastening a carry bag to a person's body in accordance with a second embodiment of the invention.
Figure 3:
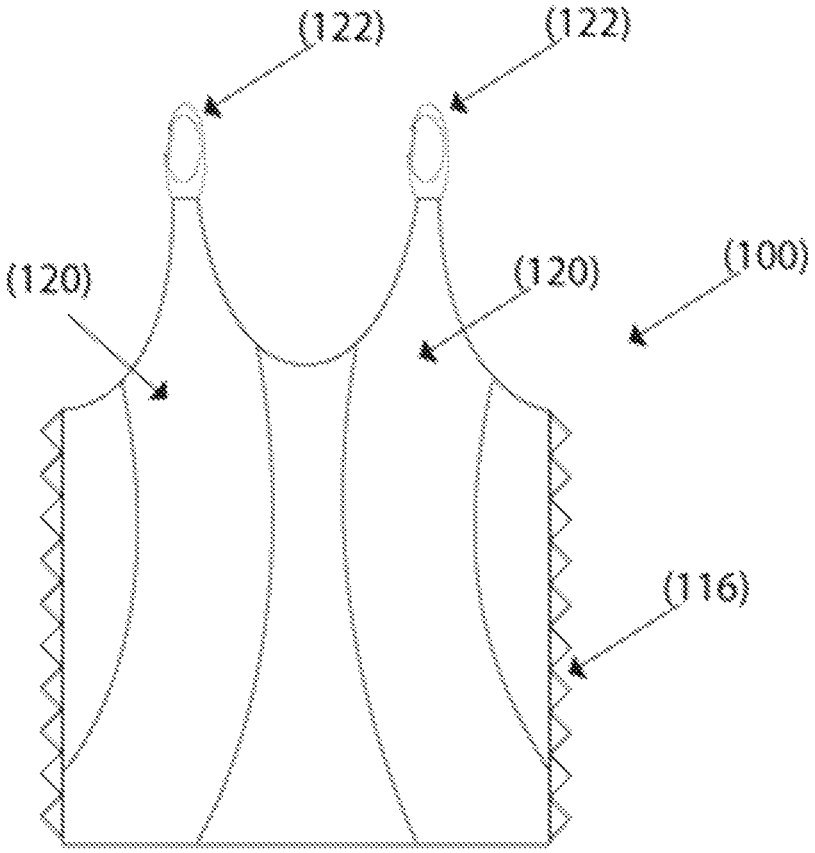
FIG. 3 shows a simplified front elevation of an interior portion of the fastener of FIG. 2.
Figure 4:
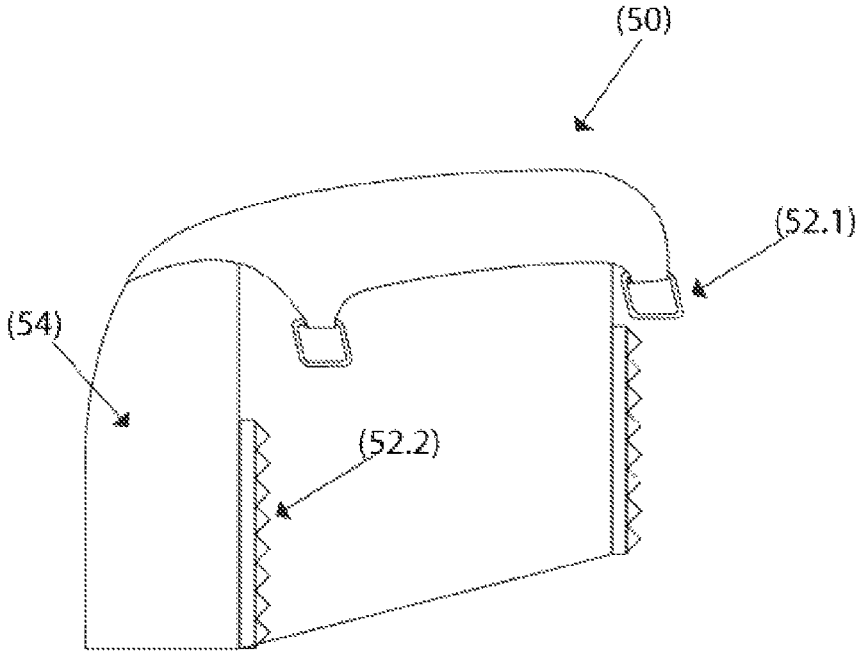
FIG. 4 shows a simplified front elevation of a carry bag that is connectable to a garment in accordance with a further embodiment of the invention.

Referring to FIGS. 1 to 3, connectors 10 and 100, resembling a waistcoat or collared vest wearable by both men and women for fastening a carry bag to a person's body in accordance with a first embodiment of the invention, is shown. FIG. 4 represents a typical carry bag 50 to which the fastener can be fastened.

In FIGS. 1 and 2, fastener 10 and 100 are shown to each have the shape of a front portion of a garment, in this embodiment a waistcoat or vest, with different aesthetic finishes. Fastener 10 includes two chest covering portions 12.1 and 12.2 which are arranged to overlap each other when worn by a person (not shown) and adapted to be tied to each other by means of buttons 14.

In contrast, fastener 100 has two chest covering portions 112.1 and 112.2 arranged to overlap each other when worn by a person and adapted to be tied to each other by means of a zip 114 located on an inwardly directed edge of each portion 112.1, 112.2 adjacent front pockets 115. FIG. 2 further shows that fastener 100 includes a collar 118 so as to form a collared vest that can be worn by a person. Although not shown in the drawings it will be appreciated that in other embodiments of the invention, fastener 10 and 100 is selectable from different wearable garments such as vests, shirts, jackets and the like; or front portions thereof.

As illustrated in FIG. 3, fastener 100 has two elongate reinforced members in the form of straps 120 which are configurable to in use, i.e. when worn by a person, be connected to engagement means 52 in the form of buckets 52.1 and zips 52.2 of the carry bag 50 so as to assist a person in carrying a load packed into carry bag 50.

The straps 120 are showed to be integrally formed with the material of the fastener 100. The straps 120 are secured to an interior portion of the chest covering portions 112.1, 112.2 so as to be unnoticeable by people other than the wearer when fastener 100 is worn as clothing. In this embodiment of the invention, each reinforced member or strap 120 includes a connector 122 in the form of a hook for connecting strap 120 to the respective buckles 52.1 of carry bag 50. Fastener 100 also includes side connectors 116 in the form of elongate zipper portions for facilitating connection of fastener 100 to carry bag 50. It will be appreciated that the straps or reinforced members 120 may have a variety of shapes and configurations in other embodiments of the invention and they may even be separate from the portions 112.1, 112.2.

Referring to FIG. 4, the carry bag 50 is shown to be a container portion 54 of a conventional backpack or rucksack. However, carry bag 50 includes engagement means in the form of buckles 52.1 and zips 52.2 and, in use, zips 52.2 are connectable to elongate zipper portions 116 while buckles 52.1 are connectable to hooks 122. In other embodiments of the invention, the connectors and engagement means may also be complimentary shaped. For example, the connectors and engagement means may compromise complementary shaped buckles, hooks, and loops, or zipper portions or combinations thereof.

The invention also extends to a garment (not shown) that is wearable by a person (i.e., a user). The garment may be a jacket, vest, waistcoat, shirt or the like which is provided with a reinforced member or strap 120 releasably connected to engagement means 52 of a carry bag 50 that is adapted to be carried on a person's body so as to in use assist the person in carrying a load packed into the carry bag 50.

It will also be appreciated that, the invention extends to a carry bag, rucksack, or backpack having a fastener 10, 100 as described hereinbefore. The carry bag, rucksack, or backpack is thus designed to allow quick change of fasteners 10, 100, or the like, thereby creating multiple design options for the wearer as multiple fasteners may be made readily available with measurements corresponding to that of the carry bag such that one would only need to have one carry bag fittable to a variety of fasteners such as, for example, 10, 100, or the like.

The present invention thus provides a simple, yet effective, flexible, and aesthetically pleasing way to safely carry goods on one's body. The front panel can be interchanged at the user's discretion to change the look of the garment. The back member can be interchanged at the user's discretion to change the look or functionality of the garment.

While preferred embodiments of the invention are shown and described, it will be understood that it is not intended to limit the extent of the invention, but rather it is intended to cover all modifications and alternate methods, including: methods of manufacturing fastener 10, 100 or components thereof falling within the spirit and the scope of the invention.

The invention claimed is:

1. A garment comprising a front panel engaged with a back member, the front panel comprising:

(a) a first chest covering portion comprising an upper connector disposed in a shoulder region of the first chest covering portion and a lower connector disposed in a waist region of the first chest covering portion;

(b) a second chest covering portion comprising an upper connector disposed in a shoulder region of the second chest covering portion and a lower connector disposed in a waist region of the second chest covering portion;

(c) a first reinforced member in physical communication with the upper connector of the first chest covering portion and integrally formed with the first chest covering portion; and (d) a second reinforced member in physical communication with the upper connector of the second chest covering portion and integrally formed with the second chest covering portion, wherein the front panel is configured to at least partially cover the chest of a user; wherein the first chest covering portion and the second chest covering portion are made from a first fabric, and wherein the first reinforcement member and second reinforcement member are made from a fabric that is stronger than the first fabric;

and wherein the back member is a carry bag and comprises:

a first upper connector disposed in a shoulder region of the back member and configured to engage with the upper connector of the first chest covering portion;

a second upper connector disposed in a shoulder region of the back member and configured to engage with the upper connector of the second chest covering portion;

a first lower connector disposed in a waist region of the back member and configured to engage with the lower connector of the first chest covering portion; and a second lower connector disposed in a waist region of the back member and configured to engage with the lower connector of the second chest covering portion.

2. The garment fastener of claim 1, wherein the first chest covering portion comprises a centre connector configured to engage with a centre connector of the second chest covering portion, and wherein the first chest covering portion and the second chest covering portion are separable.

3. The garment fastener of claim 1, wherein the first chest covering portion and the second chest covering portion are integrally connected.

4. The garment fastener of claim 1, wherein the upper connector of the first chest covering portion is configured to engage with the first upper connector of the back member, the upper connector of the second chest covering portion is configured to engage with the second upper connector of the back member, the lower connector of the first chest covering portion is configured to engage with the first lower connector of the back member, and the lower connector of the second chest covering portion is configured to engage with the second lower connector of the back member.

5. The garment fastener of claim 1, wherein the first and second reinforced members are disposed on the inside of the first and second chest covering portions, respectively, and are configured so as not to be visible when the garment fastener is worn by a person.

6. The garment fastener of claim 1, wherein the first chest covering portion comprises an outer surface, an inner surface, and a first lining covering at least a portion of the inner surface, and wherein the second chest covering portion comprises an outer surface, an inner surface, and a second lining covering at least a portion of the inner surface.

7. The garment fastener of claim 6, wherein the first reinforced member is disposed between the first chest covering portion and the first lining, and wherein the second reinforced member is disposed between the second chest covering portion and the second lining.

8. The garment fastener of claim 1, wherein the first reinforced member is in physical communication with the lower connector of the first chest covering portion, and wherein the second reinforced member is in physical communication with the lower connector of the second chest covering portion.

9. The garment of claim 1, wherein the front panel and back member are configured to form first and second arm holes, a neck hole, and a torso hole when fully engaged.

10. The garment of claim 1, wherein the first reinforced member is configured to support at least a portion of the weight of the back member when the upper connector of the first chest covering portion is engaged with the first upper connector of the back member, and wherein the second reinforced member is configured to support at least a portion of the weight of the back member when the upper connector of the second chest covering portion is engaged with the second upper connector of the back member.

11. The garment of claim 1, wherein the back member is configured to at least partially cover the back of the user.

12. The garment of claim 1, wherein the first reinforced member comprises multiple layers of fabric.

13. The garment of claim 12, wherein the back member comprises:

a first upper connector disposed in a shoulder region of the back member and configured to engage with the upper connector of the first chest covering portion;

a second upper connector disposed in a shoulder region of the back member and configured to engage with the upper connector of the second chest covering portion;

a first lower connector disposed in a waist region of the back member and configured to engage with the lower connector of the first chest covering portion; and a second lower connector disposed in a waist region of the back member and configured to engage with the lower connector of the second chest covering portion.

14. A garment comprising a front panel engaged with a back member, the front panel comprising:

(a) a first chest covering portion comprising an upper connector disposed in a shoulder region of the first chest covering portion and a lower connector disposed in a waist region of the first chest covering portion;

(b) a second chest covering portion comprising an upper connector disposed in a shoulder region of the second chest covering portion and a lower connector disposed in a waist region of the second chest covering portion;

(c) a first reinforced member in physical communication with the upper connector of the first chest covering portion and integrally formed with the first chest covering portion; and (d) a second reinforced member in physical communication with the upper connector of the second chest covering portion and integrally formed with the second chest covering portion, wherein:

the front panel is configured to at least partially cover the chest of a user;

the back member is a carry bag;

the first chest covering portion comprises an outer surface, an inner surface, and a first lining covering at least a portion of the inner surface;

the second chest covering portion comprises an outer surface, an inner surface, and a second lining covering at least a portion of the inner surface;

the first reinforced member is disposed between the first chest covering portion and the first lining; and the second reinforced member is disposed between the second chest covering portion and the second lining.

* * * * *